United States Patent [19]

Toshiyuki

[11] Patent Number: 4,741,171

[45] Date of Patent: May 3, 1988

[54] REFRIGERATED DISPLAY CABINET

[75] Inventor: Fukuda Toshiyuki, Isesaki, Japan

[73] Assignee: Sanden Corporation, Japan

[21] Appl. No.: 26,256

[22] Filed: Mar. 16, 1987

[30] Foreign Application Priority Data

Mar. 15, 1986 [JP] Japan ..... 61-38170[U]
Mar. 15, 1986 [JP] Japan ..... 61-38171[U]
Mar. 15, 1986 [JP] Japan ..... 61-38172[U]
Mar. 15, 1986 [JP] Japan ..... 61-38173[U]

[51] Int. Cl.[4] ..... F25D 21/22

[52] U.S. Cl. ..... 62/234; 62/256; 62/278

[58] Field of Search ..... 62/81, 152, 199, 234, 62/255, 256, 278

[56] References Cited

U.S. PATENT DOCUMENTS 3,122,892 3/1964 Beckwith ..... 62/278 X
3,464,226 9/1969 Kramer ..... 62/278 X
3,499,295 3/1970 Brennan ..... 62/278 X
3,638,444 2/1972 Lindahl ..... 62/81
4,122,686 10/1978 Lindahl et al. ..... 62/81
4,644,758 2/1987 Maehara et al. ..... 62/256 X

*Primary Examiner*—William E. Tapolcai
*Attorney, Agent, or Firm*—Banner, Birch, McKie & Beckett

[57] ABSTRACT

A refrigerated display case with multiple air curtains and a refrigerating system for refrigerating circulation air is disclosed. The refrigerating system includes a compressor, a condenser and two evaporators. One terminal port of both evaporators, positioned on the bottom portion of each evaporator, is alternately and selectively connected with the discharge side of the condenser or the suction port of the compressor through a four-way valve. The other terminal ports of both evaporators, positioned on the upper portion of each evaporator, are connected to each other through communicating lines. The communicating lines are connected to each other by a connecting line. A connecting line also connects a point between the two four-way valves to one of the communicating lines. The two communicating lines and the connecting lines are provided with at least one expansion valve and a plurality of electromagnetic valves and check valves.

9 Claims, 9 Drawing Sheets

REFRIGERATED DISPLAY CABINET

TECHNICAL FIELD

This invention relates to a refrigerated display cabinet having improved refrigerating means. More particularly, this invention relates to an improved refrigerated display cabinet which may be efficiently defrosted during operation of the refrigerating system.

BACKGROUND OF THE INVENTION

Refrigerated display cabinets which have a front opening and multiple air curtains to isolate the refrigerated space from ambient atmosphere are well known. With this type of cabinet, refrigerated foods and other merchandise can be easily removed from or placed in the refrigerated space.

Such cabinets have gained wide acceptance in the food inustry. Air provides an innermost curtain and at least one adjacent outer air curtain across the front opening. The air curtains are normally circulated through conduits provided within the display cabinet. The innermost air curtain is normally the coldest and the other air curtains are somewhat warmer. A refrigerating means, including one or more evaporators, is located in the innermost curtain conduit for cooling the air.

In this type of refrigerated display cabinet, the innermost curtain conduit and refrigerating means must be defrosted periodically to remove accumulated frost from the evaporators. This frost, formed from the circulating air, impedes the operation of the equipment. Commercially, defrosting has been achieved by high voltage electrical heaters located adjacent the evaporator. With electrical heater defrosting, the refrigerating operation is temporarily halted while air continues to circulate. Thus, the circulating air is warmed by the electrical heater. This warm air melts frost built up on the evaporator. It is important to melt this frost as rapidly as possible in order to minimize temperature rise of the refrigerated goods and to minimize frost collection on the refrigerated goods caused by the higher humidity of the recirculated warm air. In some instances, a hot gas is passed through the evaporator of the refrigerating means. However, the hot gas defrost method is complex in its construction and is practical in only a small percentage of installations.

One method of resolving the above disadvantages is disclosed in Maehara et al., U.S. Pat. No. 4,644,758 issued on Feb. 24, 1987. As shown in FIG. 1, the refrigerating apparatus of this prior invention includes a compressor 1, a condenser 2, and two evaporators 3*a* and 3*b* each of which are serially connected to compressor 1 and condenser 2. The suction sides of both evaporators 3*a*, 3*b* are connected to condenser 2 through valve devices 4*a*, 4*b*, respectively, and are connected to each other by a first passage line which includes first and second expansion valves 5*a*, 5*b* and first and second check valves 6*a*, 6*b*, respectively, in series. The discharge sides of both evaporators 3*a*, 3*b* are also connected to each other by a second passage line which includes a pair of check valves 6*c*, 6*d*. This second passage line is connected to the compressor through valve devices 4*c* and 4*d*. The first and second passage lines are connected to each other and to condenser 2 through a valve device 4*e*.

In this construction of a refrigerating apparatus for a refrigerated display cabinet, if valve devices 4*c*, 4*d*, 4*e* are opened, the refrigerant passes through both evaporators 3*a*, 3*b*, which are connected in parallel, while being expanded within the evaporators as indicated by the solid arrows in FIG. 1. Therefore, the air passed through the evaporators is cooled by indirect heat exchange with the refrigerant.

If valve devices 4*a* and 4*d* only are opened, evaporators 3*a* and 3*b* are serially connected to each other, and condensed refrigerant is passed first through evaporator 3*a* and then through expansion valve 5*b* and evaporator 3*b* as indicated by the dotted and dashed arrows in FIG. 1. Therefore, evaporator 3*a* is defrosted by the condensed (unexpanded) refrigerant, and air passing through evaporator 3*b* is cooled by the expanded refrigerant. Conversely, if valve devices 4*b* and 4*c* are opened, evaporator 3*b* is defrosted. Therefore, one evaporator can be partially defrosted by the condensed refrigerant while air is refrigerated in the other evaporator by the expanded refrigerant.

However, the defrost operation in this refrigerating apparatus is insufficient. In the defrost mode, heated and highly pressurized condensed refrigerant is introduced into the evaporator at its upper terminal end allowing the upper portion of the evaporator to be defrosted by condensed refrigerant. However, refrigerant with a lower temperature is passed through the lower portion of the defrosting evaporator. This lengthens the time required to completely defrost the lower portion of the evaporator.

Also, after the frost is melted, the surface temperture of the evaporator is raised to the temperature of the condensed refrigerant. As a result, the air temperature on the peripheral portion of the evaporator is raised. But this phenomenon only occurs on the upper portion of the evaporator. Heated air does not effectively melt the frost on the lower portion of the evaporator. Furthermore, heated air remains in the space between the upper surface of the evaporator and a shutter element. Therefore, if the sealing between the shutter element and the air passageway or heat insulation of the shutter element is insufficient, the heated air is transmitted to the cold air passed through the cooling passageway.

Moreover, in this refrigerating apparatus, each evaporator has a corresponding expansion valve. The expansion valves are operated under different conditions: the full refrigerating mode or the defrosting mode. The refrigerant flow for these conditions is different. If the capacity of the expansion valve is sufficient for the refrigerating mode, the capacity is insufficient in the defrosting mode. Conversely, if the capacity of the expansion valve is sufficient for the defrosting mode, the capacity is in excess of that required in the refrigerating mode. This type of operation of the expansion valve is unstable and causes a large load to act on the compressor. Also, this operation increases manufacturing costs of the refrigerating apparatus.

SUMMARY OF THE INVENTION

It is an object of this invention to provide an improved refrigerated display cabinet having refrigerating means for effectively defrosting an evaporator without affecting the cooling operation.

It is another object of this invention to provide a refrigerated display cabinet having refrigerating means which effectively circulates cold air while defrosting is in progress.

It is still another object of this invention to provide a refrigerated display cabinet which is relatively inexpensive while maintaining efficiency.

A refrigerated display cabinet according to the present invention includes an external housing, an internal housing within the external housing for storing merchandise, and a front opening for permitting access to the interior of the internal housing. A passage is formed between the external and internal housings and includes inner and outer conduits connecting respective inlets and outlets extending across opposed edges of the front opening. A circulator drives air through the passage and from the outlets to the inlets in the form of inner and outer air curtains, and a refrigerating system in the inner conduit refrigerates the inner curtain of air. The refrigerating system includes a compressor, a condensor and two evaporators.

Two four-way valves are each connected to the bottom terminal port of a respective evaporator for selectively and alternately connecting the bottom terminal port of each evaporator to the outlet side of the condensor and the suction port of the compressor. The upper portions of each evaporator are connected to each other by two communicating lines disposed in parallel. The communicating lines are connected to each other at a middle point by a connecting line through an electromagnetic valve. Another connecting line is connected between one of the communicating lines and a point between the two four-way valves through another electromagnetic valve. The two communicating lines and two connecting lines are provided with at least one expansion valve and two check valves.

Various additional advantages and features of novelty which characterized the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF PREFERRED EMBODIMENTS

Figure 2:
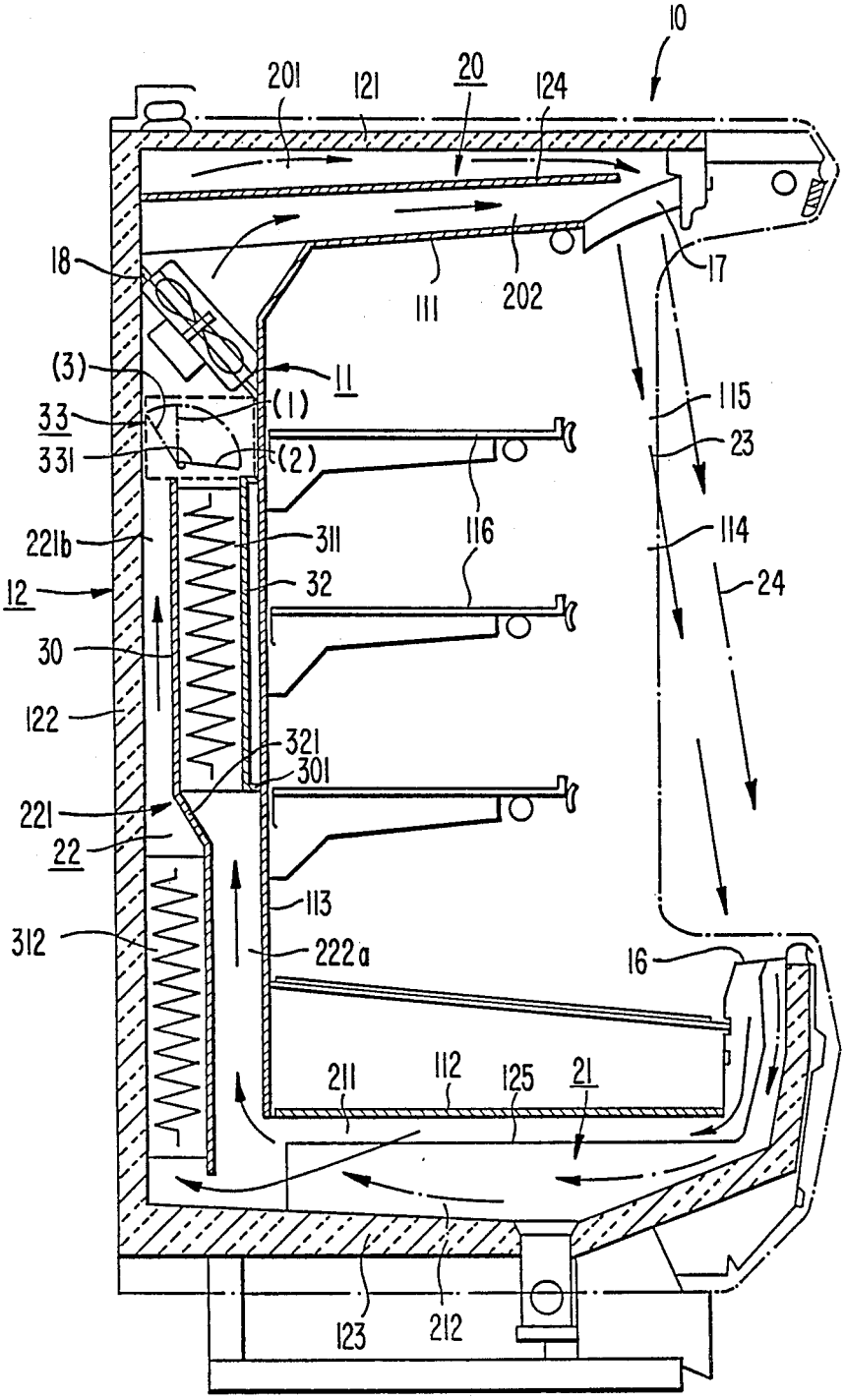
FIG. 2 is a vertical sectional view of a refrigerated display cabinet provided with a refrigerating system according to one embodiment of this invention.

Referring to FIG. 2, one embodiment of a refrigerating display cabinet is shown in which a refrigerating system in accordance with the present invention is disposed. Cabinet 10 has an internal housing 11 providing a display space D and an external housing 12. Internal housing 11 is defined by top panel 111, bottom panel 112, and rear panel 113 extending in an upright direction between top and bottom panels 111 and 112. Display space D is bounded on the sides by a pair of side wall panels, one side wall panel 114 being indicated in FIG. 2 by a dotted and dashed line. Display space D has front opening 115 for easy access to the interior of display space D from the outside. Furthermore, display space D is divided into sections by a plurality of vertically spaced, generally horizontal shelves 116 which are mounted, preferably adjustably, on suitable uprights carried by rear panel 113.

External housing 12 is defined by top wall 121, vertical rear wall 122, and bottom wall 123, each of which is usually made of an insulating material. The space between the panels of interior housing 11 and external housing 12 provides a plurality of air flow conduits to define multiple air curtains. Thus, between top wall 121 and top panel 111, top divider panel 124 divides top space 20 into upper passage 201 and lower passage 202. Bottom space 21 formed between bottom panel 112 and bottom wall 123 is divided by bottom divider panel 125 into upper passage 211 and lower passage 212. Rear space 22 formed between rear panel 113 and rear wall 122 is divided by two laterally spaced separator plates (not shown) to form three separate generally vertical passages which are located transversely of rear wall 122 and are parallel with each other.

Central passage 221 of three passages, in which a refrigerating unit is disposed, communicates with lower passage 202 of top space 20 and upper passage 211 of bottom space 21 to form a first air circulating conduit. Both side passages of the three vertical passages are connected with upper passage 201 of top space 20 and lower passage 212 of bottom space 21 to form a second air circulating conduit. Air inlets 16 are provided for each of the air circulating conduits. Air streams 23 and 24 which cross front opening 115 of display space D pass into inlets 16 and are driven through the conduits to discharge outlets 17 leading from top space 20. The air streams are recirculated in a clockwise direction as indicated on FIG. 2 by the arrows.

As mentioned above, the first air circulating conduit is defined around display space D. Air flowing through this first air circulating conduit, forms an enclosing air curtain across front opening 16 of display space D as inner air stream 23. Outer passages 201, 212 of top and bottom spaces 20, 21 respectively, and rear space 22 between rear panel 113 and rear wall 122 define a second air circulating conduit which forms a second air curtain outside of inner air stream 23. The inlet and outlet of the second air circulating conduit are adjacent to and disposed outwardly of the inlet and outlet of the first air circulating conduit to provide a path for outer air stream 24.

During normal operation, air is circulated through the first and second air circulating conduits by a plurality of motor operated fans 18 disposed in the upper portion of rear space 22. The temperature of the air passed through the second air circulating conduit is slightly higher than the temperature of the air passed through the first air circulating conduit, but is below the temperature of the ambient atmosphere. Therefore, the air curtain created by outer air stream 24 in the second air circulating conduit protects against reduction of the temperature of inner air stream 23 travelling in the first air circulating conduit.

Central passage 221 within rear space 22, which is part of the first air circulating conduit, is divided by a generally vertical partition plate 30 to form an inner passage or chamber 221*a* and an outer passage or chamber 221*b*. The width of inner and outer passages 221*a* and 221*b* is changed by a stepped portion 301 of partition plate 30. An enlarged width is formed at the upper part of inner passage 221*a* and at the lower part of outer passage 221*b*.

Evaporators 311 and 312 are disposed in the wider parts of passages 221*a* and 221*b*, respectively. First evaporator 311, disposed in inner passage 221*a*, is fixed between partition plate 30 and attachment plate 32. Second evaporator 312, disposed in outer passage 221*b*, is fixed between partition plate 30 and vertical rear wall 122. Attachment plate 32 is fastened on rear panel 113 through flange 321 which extends across the side surface of evaporator 311 to cover the surface to prevent leakage of unrefrigerated air.

Damper box 33 which includes shutter plate 331 is disposed in the upper part of central passage 221 to cover the discharge openings of inner and outer passages 221*a*, 221*b* thereby controlling the opening and closing of passages 221*a*, 221*b*.

Figure 1:
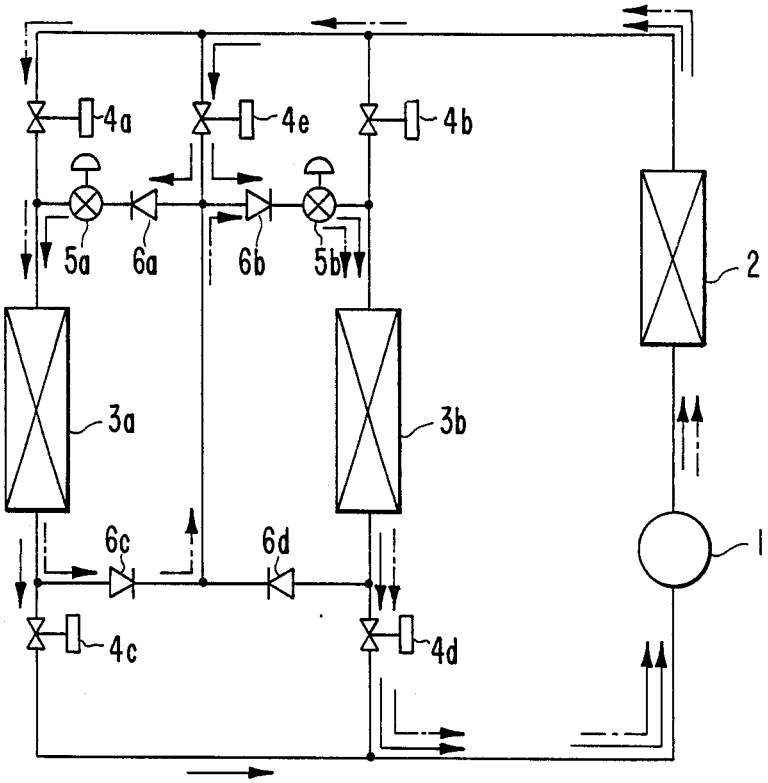
FIG. 1 PRIOR ART
FIG. 1 shows a refrigeration circuit of a prior refrigerating system.
Figure 3:
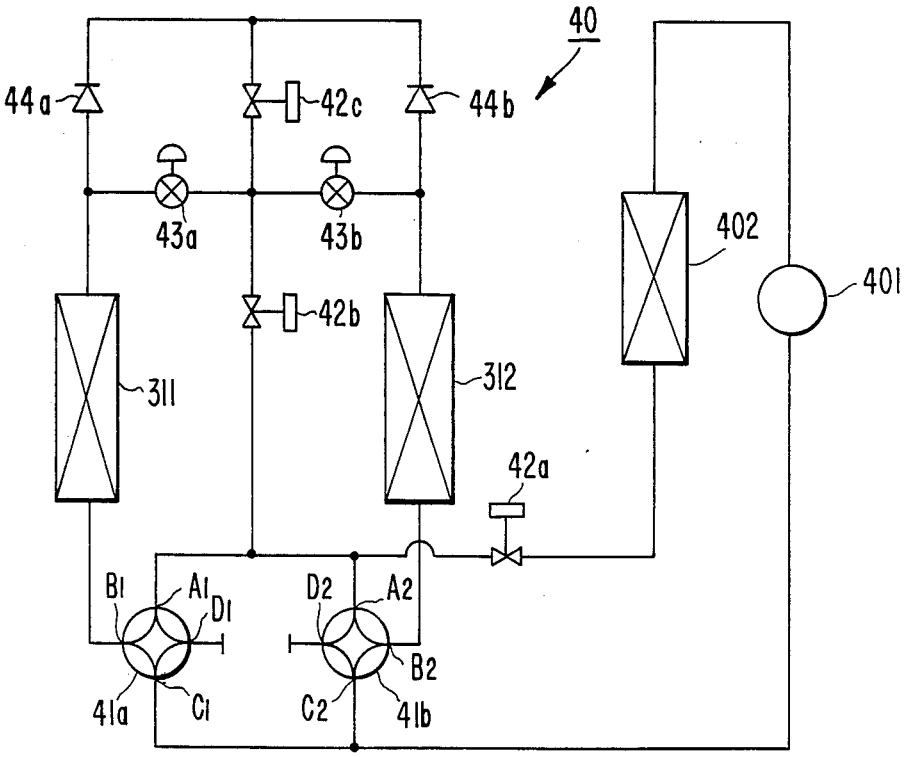
FIG. 3 is a schematic view of a refrigeration circuit of a refrigerating system according to one embodiment of this invention.

Referring to FIG. 3, one embodiment of a refrigerating system 40 for use in refrigerated display cabinet 10 comprises compressor 401, condenser 402 and two evaporators 311 and 312. Each of these components is serially connected to each other to form a closed loop refrigeration circuit. The discharge port of compressor 401 is connected with the inlet side of condenser 402. The outlet line from condenser 402 is connected with the inlet side of each evaporator 311, 312 through four-way valves 41*a*, 41*b*, respectively. The inlet sides of evaporators 311, 312 are positioned on the bottom of evaporators 311, 312 and have bottom terminal ports for allowing the passage of refrigerant into and out of the evaporators.

First discharge ports A1, A2 of four-way valves 41*a*, 41*b*, respectively, are connected to the outlet side of condenser 402 through first electromagnetic valve 42*a*. Second discharge ports B1, B2 of four-way valves 41*a*, 41*b* are connected to the inlet sides of evaporators 311, 312, respectively. Third discharge ports C1, C2 of four-way valves 41*a*, 41*b*, respectively, are connected to the suction port of compressor 401. Fourth discharge ports D1, D2 of four-way valves 41*a*, 41*b*, respectively, are closed.

If four-way valves 41*a*, 41*b* are energized, first discharge port A1, A2 communicate with fourth discharge ports D1, D2, and second discharge ports B1, B2 communicate with third discharge ports C1, C2, respectively, so that the inlet side of evaporators 311, 312 are connected to the suction port of compressor 401. On the other hand, if four-way valves 41*a*, 41*b* are not energized, first discharge ports A1, A2 communicate with second discharge ports B1, B2, and third discharge ports C1, C2 communicate with fourth discharge ports D1, D2, respectively, so that the outlet side of condenser 402 is connected to the inlet side of evaporator 311, 312.

Also, the outlet sides of each evaporator 311, 312, which are positioned on the upper portion evaporators 311, 312 are connected to each other by first and second communicating lines. Passage of refrigerant into and out of the outlest sides of the evaporators is through top terminal ports. The first communicating line is provided with first and second expansion valves 43*a*, 43*b* and is connected in parallel with the second communicating line which is provided with first and second check valves 44*a*, 44*b*. Check valves 44*a*, 44*b* restrict refrigerant flow into evaporators 311, 312 from their respective outlet sides. The first communicating line is connected to a point between first and second four-way valves 41*a*, 41*b* through second electromagnetic valve 42*b* and is connected to the second communicating line through third electromagnetic valve 42*c*.

Figure 4:
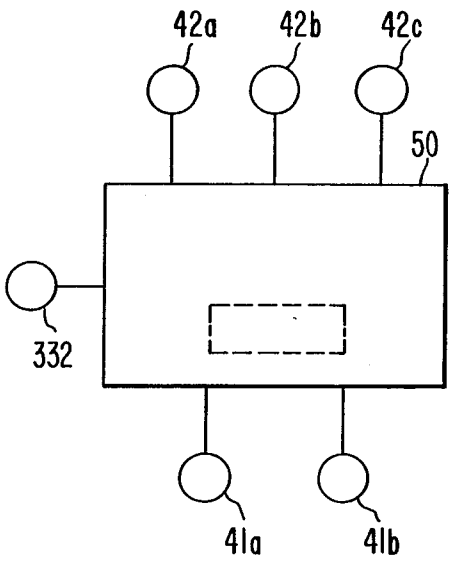
FIG. 4 is a schematic view illustrating an electrical control device for the refrigerated display cabinet of FIG. 2.

The operation of the three electromagnetic valves 42*a*, 42*b*, 42*c*, which function as control valves, two four-way valves 41*a*, 41*b* and a driving mechanism for shutter plate 331 of damper box 33 are controlled by controller 50 (shown in FIG. 4) which is provided with a timer function. Each component of the valve and driving mechanisms are controlled by a predetermined set time, an example of which is shown as a chart in FIG. 5.

Figure 5:
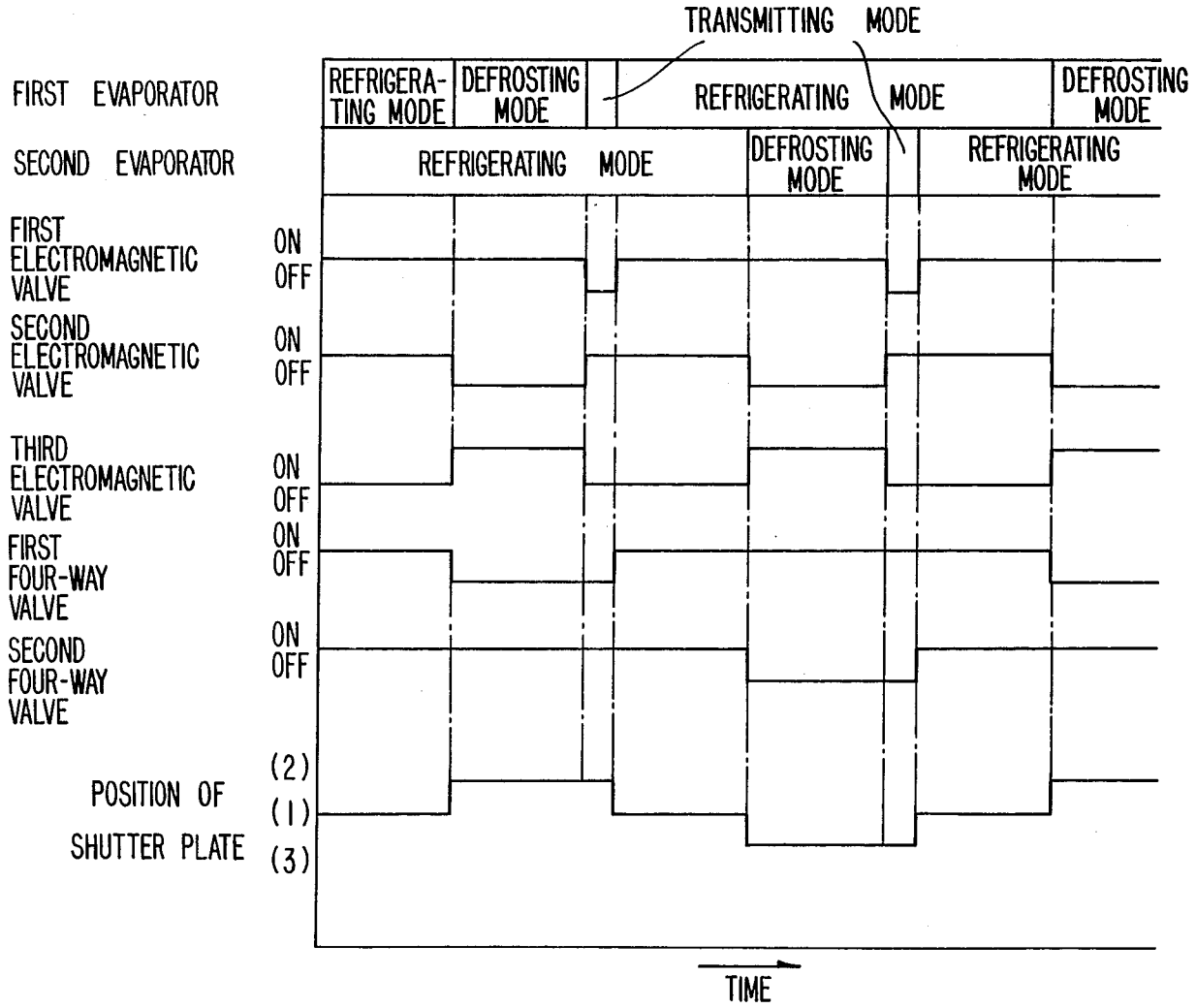
FIG. 5 is a chart illustrating the conditions of the electromagnetic valves and four-way valves of the refrigeration circuit of FIG. 3.
Figure 6A:
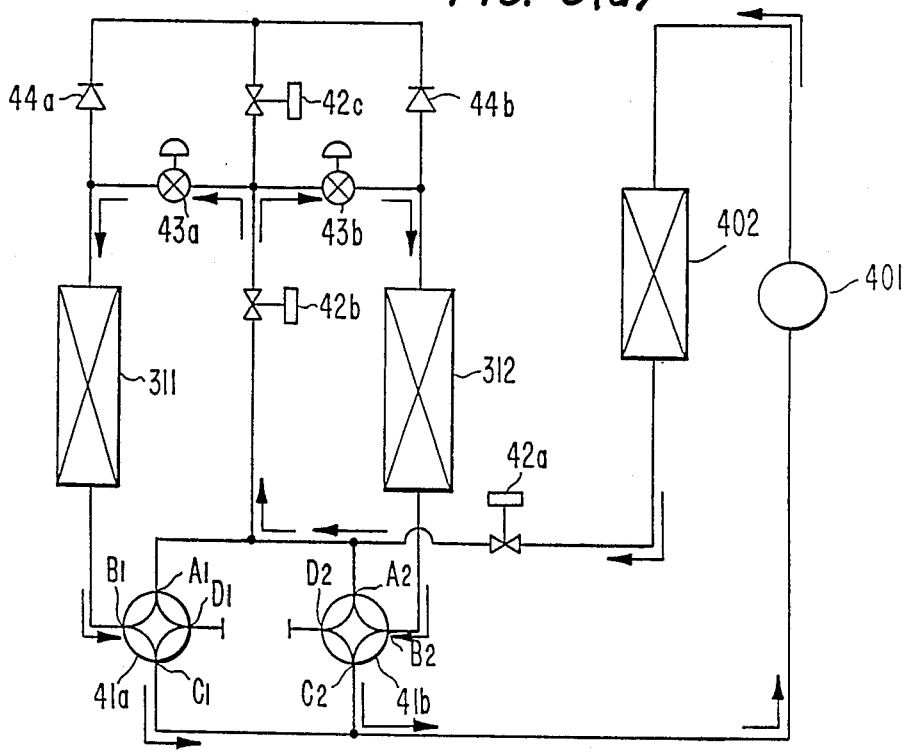
FIGS. 6(*a*)–(*c*) are schematic views of refrigeration circuits illustrating operational modes of the refrigerating system of FIG. 3.
Figure 6B:
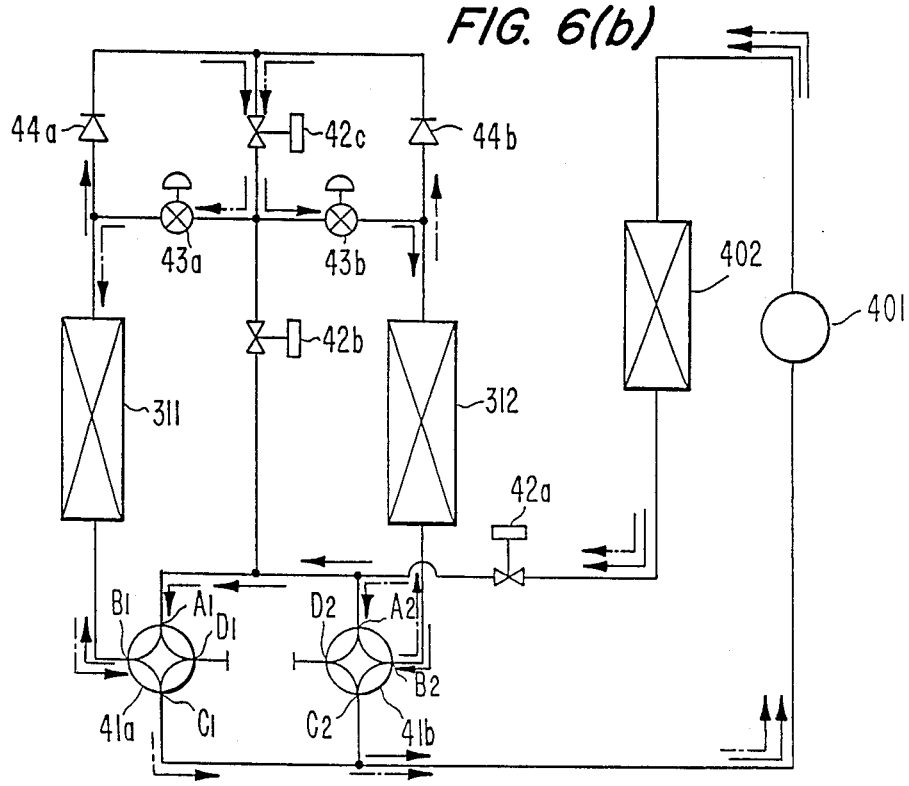
Figure 6C:
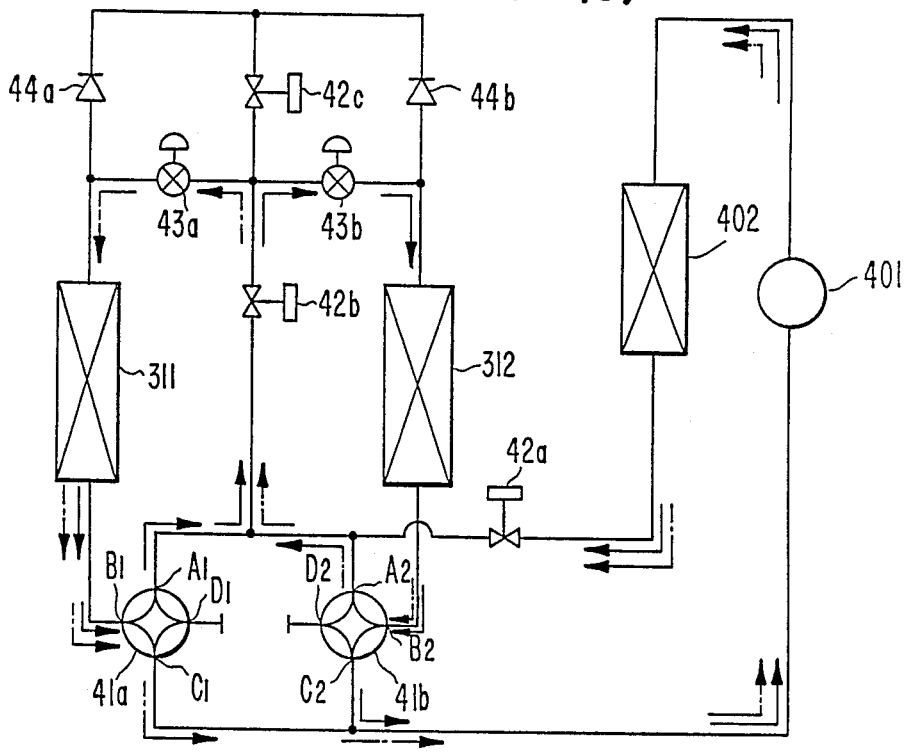

The operation of refrigerating system 40 will be described by referring to FIGS. 5 and 6. When first and second electromagnetic valves 42*a*, 42*b*, and both four-way valves 41*a*, 41*b* are energized, refrigerant flows into both first and second evaporators 311, 312 through expansion valves 43*a*, 43*b*, respectively. Evaporators 311, 312 are placed on line in refrigerating system 40 by means of a parallel connection. This situation is shown in FIG. 6(*a*) and the flow of refrigerant is indicated by the solid arrows. This operating mode is the refrigerating mode.

In this mode, shutter plate 331 in damper box 33 is positioned at its midway location (1) to open both discharge openings of inner and outer passages 221*a*, 221*b*. Therefore, both evaporators 311, 312 function in cooling the circulating air passed through the inner and outer passages 221*a*, 221*b*. The refrigerant passed through both evaporators 311, 312 returns to the suction port of compressor 401 through second and third discharge ports B, C of four-way valves 41*a*, 41*b*.

On the other hand, when first and third electromagnetic valves, 42*a*, 42*c* and second four-way valve 41*b* are energized and second electromagnetic valve 42*b* and first four-way valve 41*a* are not energized, the suction line of condenser 402 is connected with the suction side of first evaporator 311 through first and second discharge ports A1, B1 of first four-way valve 41*a*. The inlet side of second evaporator 312 is connected with the suction port of compressor 401 through second and third discharge ports B2, C2 of second four-way valve 41*b*. Also, the discharge side of first evaporator 311 is connected with the discharge side of second evaporator 312 through first check valve 44*a*, third electromagnetic valve 42*c* and second expansion valve 43*b*. Thus both evaporators 311, 312 are serially connected on line in refrigerating system 40. This situation is shown in FIG. 6(*b*) and the flow of refrigerant is indicated by the solid arrows. This operating mode is the first defrosting mode.

In this mode, shutter plate 331 is moved to position (2) to close the discharge opening of inner passage 221*a*. The hot and highly pressurized condensed refrigerant passes through first evaporator 311 and is expanded through expansion valve 43*b* before flowing into second evaporator 312 to exchange heat with and cool the circulating air. Therefore, second evaporator 312 cools the circulating air passed through outer passage 221*b* while first evaporator 311 is defrosted by hot and highly pressurized condensed refrigerant.

When first and third electromagnetic valves 42*a*, 42*c* and first four-way valve 41*a* are energized, and second electromagnetic valve 42*b* and second four-way valve 41*b* are not energized, the inlet side of second evaporator 312 is connected to the outlet side of condenser 402 through first and second discharge ports A2, B2 of second four-way valve 41*b* and the inlet side of first evaporator 311 is connected with the suction port of compressor 401 through B1, C1 of first four-way valve 41*a*. The outlet side of second evaporator 312 is connected with the outlet side of first evaporator 311 through second check valve 44*b*, third electromagnetic valve 42*c* and expansion valve 43*a*. In this situation, evaporators 311, 312 are serially connected to each other. The flow of refrigerant in this situation is indicated by the dotted and dashed arrows in FIG. 6(*b*). In this condition, the hot and highly pressurized condensed refrigerant is passed through second evaporator 312 and is expanded through expansion valve 43*a* before flowing into first evaporator 311 to exchange heat with and cool the circulating air. Thus, second evaporator 312 is defrosted and first evaporator 311 cools the circulating air passed through inner passage 221*a* while shutter plate 331 has been moved to position (3). This operation is the second defrosting mode.

In this embodiment of refrigerating system 40, changing from defrosting one evaporator to defrosting the other evaporator could result in the refrigerating mode of both evaporators being bypassed. Liquid refrigerant which flows through the defrosted evaporator could be directly returned to the suctionport of compressor 401 and damage the compressor. Thus, during a change of operation modes, liquid refrigerant should be vaporized by passing it through the expansion valve and another evaporator. Thus, a change from the first defrosting mode operation to the refrigerating mode operation can be safely achieved by a first transmitting mode wherein first and third electromagnetic valves 42*a*, 42*c* and first four-way valve 41*a* are not energized and second electromagnetic valve 42*b* and second four-way valve 41*b* are energized. Liquid refrigerant passes through second evaporator 312 through expansion valve 43*b*. (The flow of refrigerant is indicated by the solid arrows in FIG. 6(*c*)). On the other hand, a change from the second defrosting mode to the refrigerating mode operation can be safely achieved by the second transmitting mode where first and third electromagnetic valves 42*a*, 42*c* and second four-way valve 41*b* are not energized and second electromagnetic valve 42*b* and first four-way valve 41*a* are energized to pass liquid refrigerant in first evaporator 311 through expansion valve 43*a*. (The flow of refrigerant is indicated by the dotted and dashed arrows in FIG. 6(*c*)).

As mentioned above, both terminal ports of the evaporator are selectively connected with the outlet side of condensor 402. Therefore, heat and highly pressurized condensed refrigerant can flow into the evaporators from the lower port for defrosting the evaporator and can flow into the evaporators from the upper port for cooling the air. Thus, frost positioned on the lower part of the evaporator is easily defrosted and warm air around the lower portion of the evaporator rises upwardly along the evaporator. This warm air and the hot and highly pressurized condensed refrigerant pass through the evaporator to defrost the upper portion of the evaporator. Since the warm air rising from the lower portion of the evaporator promotes heat exchange with frost on the evaporator to melt the frost, the temperature around the discharge opening of inner and outer passages 221*a*, 221*b* is not greatly influenced by the defrosting operation.

Figure 7:
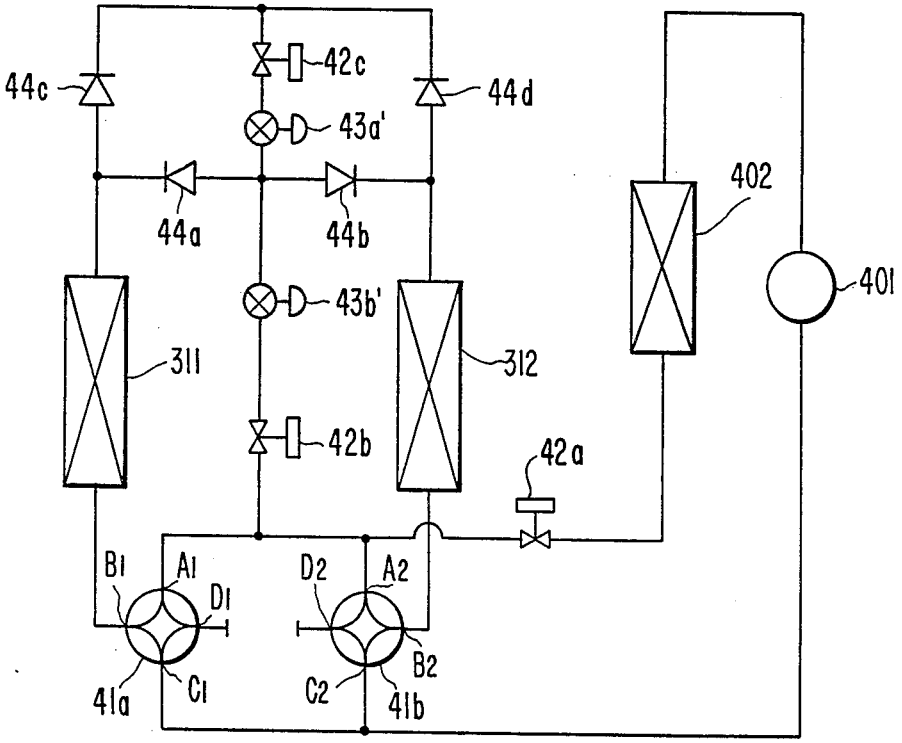
FIG. 7 is a schematic view of a refrigeration circuit of a refrigerating system according to another embodiment of this invention.

Referring to FIG. 7, another embodiment of this invention is shown. This embodiment is directed to a modification of the connection lines between the discharge sides of both evaporators 311, 312 and between the discharge side of condenser 402 and the discharge side of evaporators 311, 312.

Third and fourth check valves 44*c*, 44*d* are disposed on the first communicating line between the outlet side of both evaporators 311, 312 to permit refrigerant flow into each evaporator 311, 312 from the outlet side of condenser 402. First expansion valve 43*a*′ is placed on the connecting line between the first and second communicating lines. Second expansion valve 43*b*′ is disposed on the connecting line between the first communicating line and first magnetic valve 42*a*.

Figure 8A:
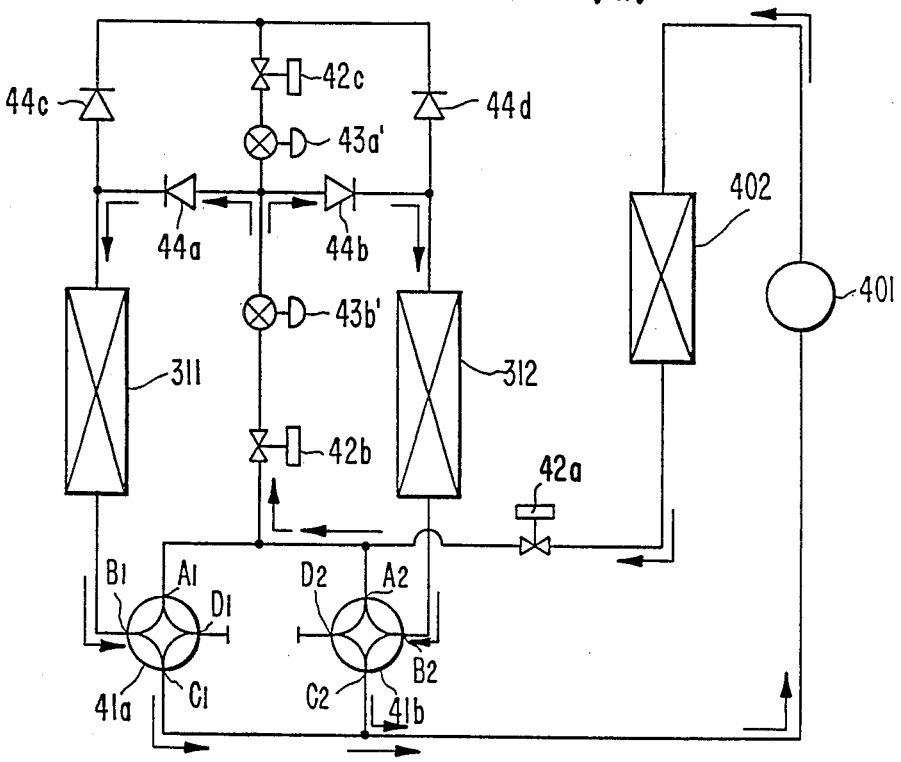
FIGS. 8(*a*)–(*c*) are schematic views of refrigeration circuits illustrating operational modes of the refrigerating system of FIG. 7.
Figure 8B:
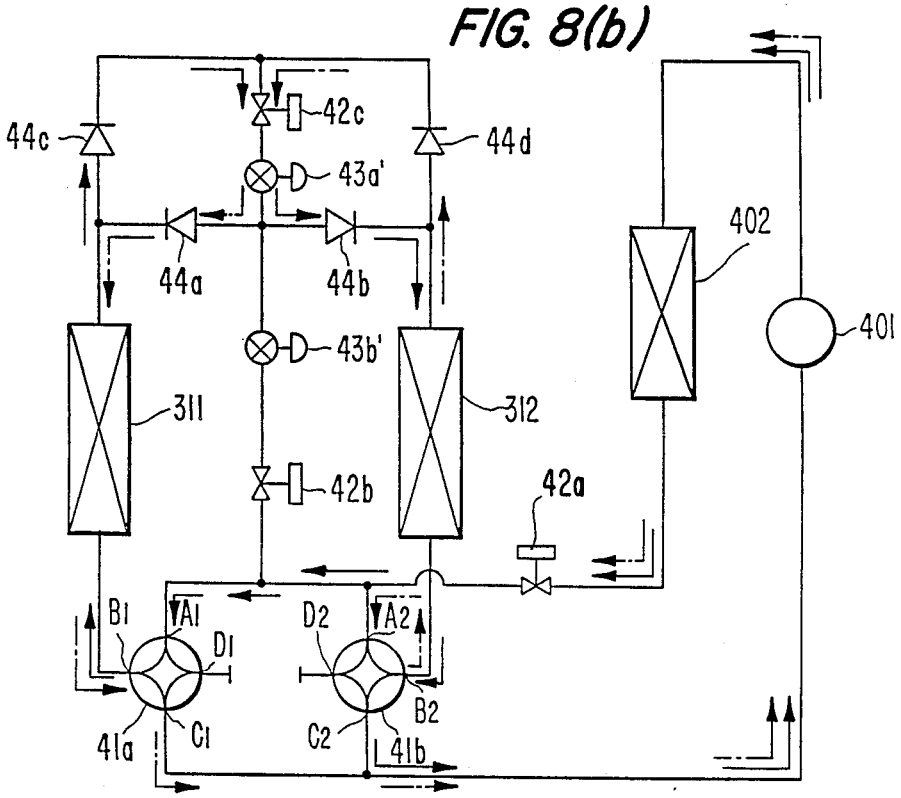
Figure 8C:
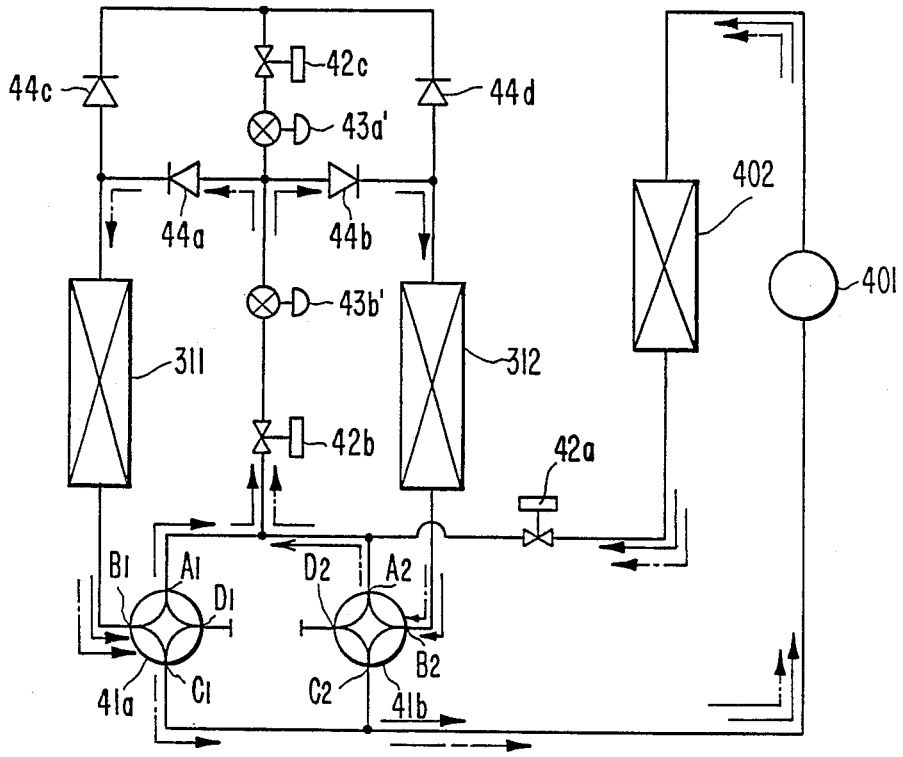

In the refrigerating mode shown in FIG. 8(*a*), all refrigerant passes through the second expansion valve 43*b*′ and exchanges heat with and cools the circulated air passed through inner and outer passages 221*a*, 221*b*, as shown by the solid arrows.

In the first or second defrosting modes shown in FIG. 8(*b*) and indicated by solid and dotted and dashed arrows, respectively, the refrigerant which flows into one evaporator 311, 312 passes through first expansion valve 43*a*′ to defrost one evaporator by hot and highly pressurized condensed refrigerant, and cools the circulated air in the other evaporator.

Furthermore, in the first and second transmitting modes shown in FIG. 8(*c*) and indicated by solid and dotted and dashed arrows, respectively, the liquid refrigerant remaining in the defrosting evaporator flows into the other evaporator through second expansion valve 43*b*′.

As mentioned above, each expansion valve 43*a*′, 43*b*′ is selectively used to determine the amount of refrigerant flow, i.e. valve 43*b*′ is used when both evaporators are in the refrigerating mode, while valve 43*a*′ is used when only one of the evaporators is in the refrigerating mode. Therefore, the capacity of each expansion valve can be predetermined and operation of the refrigerating system can be stablized. This reduces the load acting on the compressor.

Figure 9:
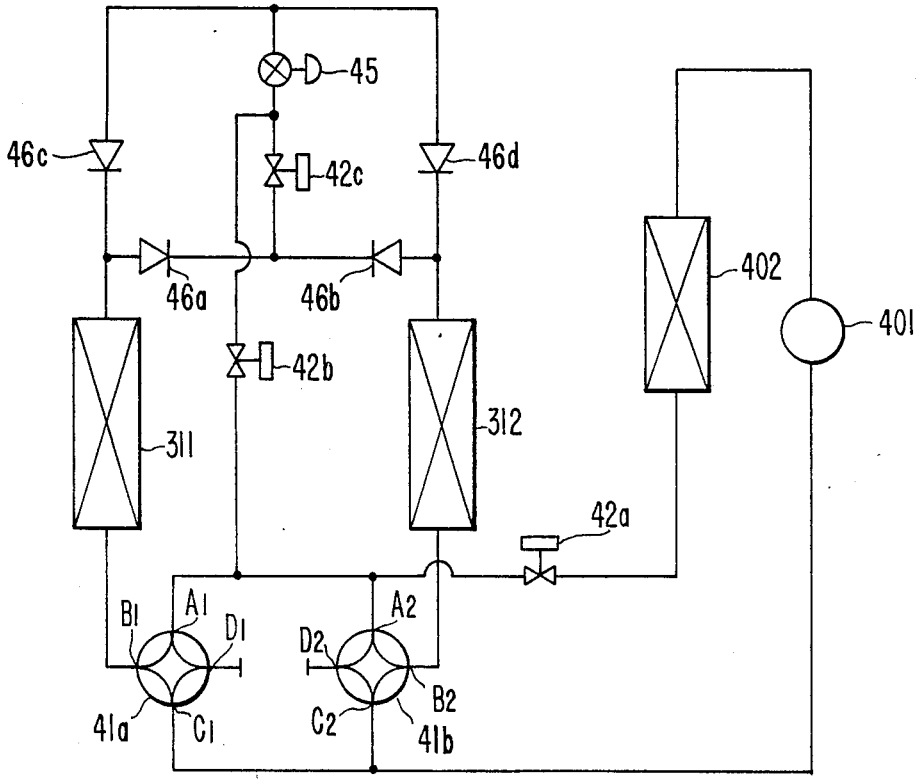
FIG. 9 shows a refrigeration circuit of a refrigerating system according to another embodiment of this invention.

FIG. 9 shows another embodiment of the refrigerating system according to this invention in which the communicating line between the outlet side of both evaporators and between the connecting line and outlet side of condenser is modified. In this embodiment, the outlet side of first and second evaporators 311, 312 communicate with each other through two communicating lines disposed in parallel. One of the two communicating lines is provided with first and second check valves 46*a*, 46*b* each of which prevents the flow of refrigerant into the outlet side of evaporators 311, 312, respectively. Also, the second communicating line is provided with third and fourth check valves 46*c*, 46*d*, each of which prevents the flow of refrigerant from the outlet side of evaporators 311, 312, respectively. Furthermore, the two communicating lines are connected to each other through expansion valve 45 and third electromagnetic valve 42*c*. A connecting line from a point between expansion valve 45 and third electromagnetic valve 42*c* extends to a point between first and second four-way valves 41*a*, 41*b*, through second electromagnetic valve 42*b*.

Figure 10A:
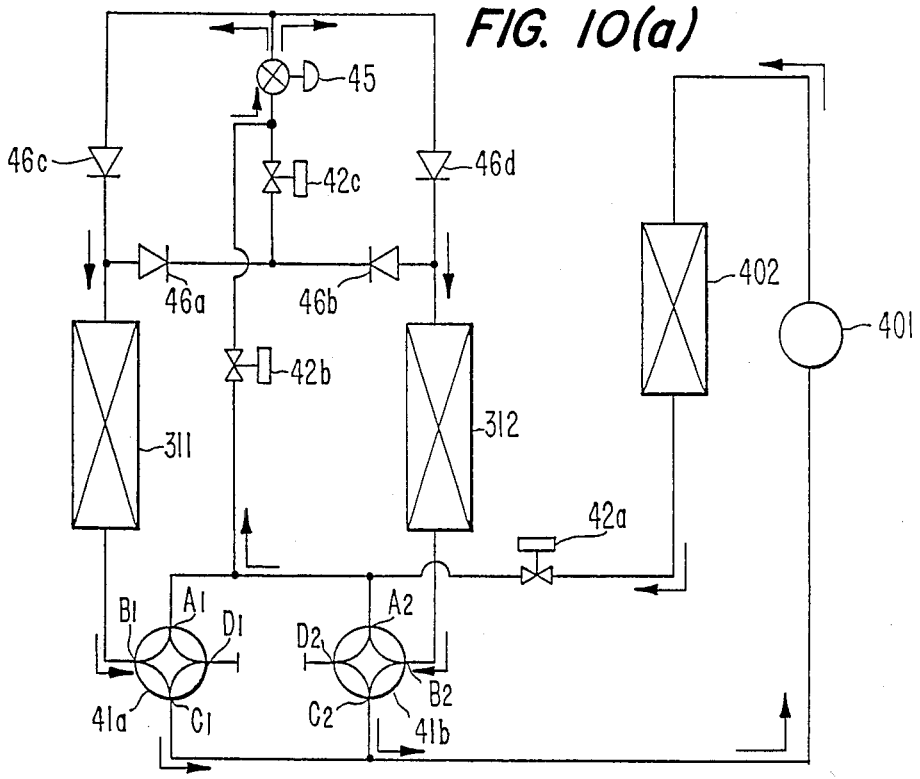
FIGS. 10(*a*)–(*c*) are schematic views of refrigeration circuits illustrating operational modes of the refrigerating system of FIG. 9.
Figure 10B:
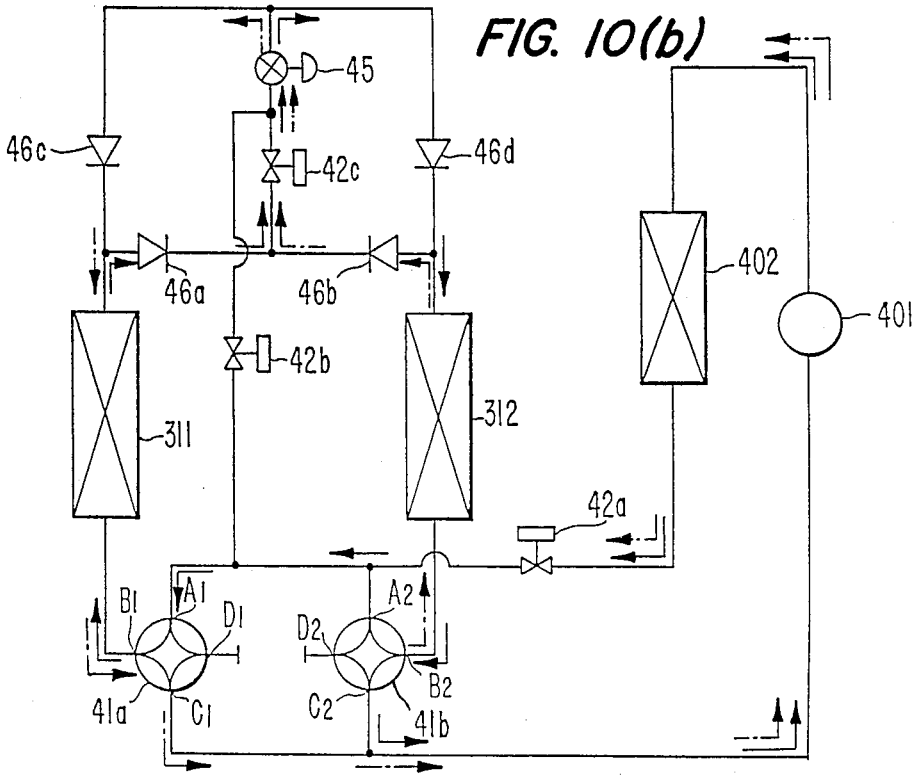
Figure 10C:
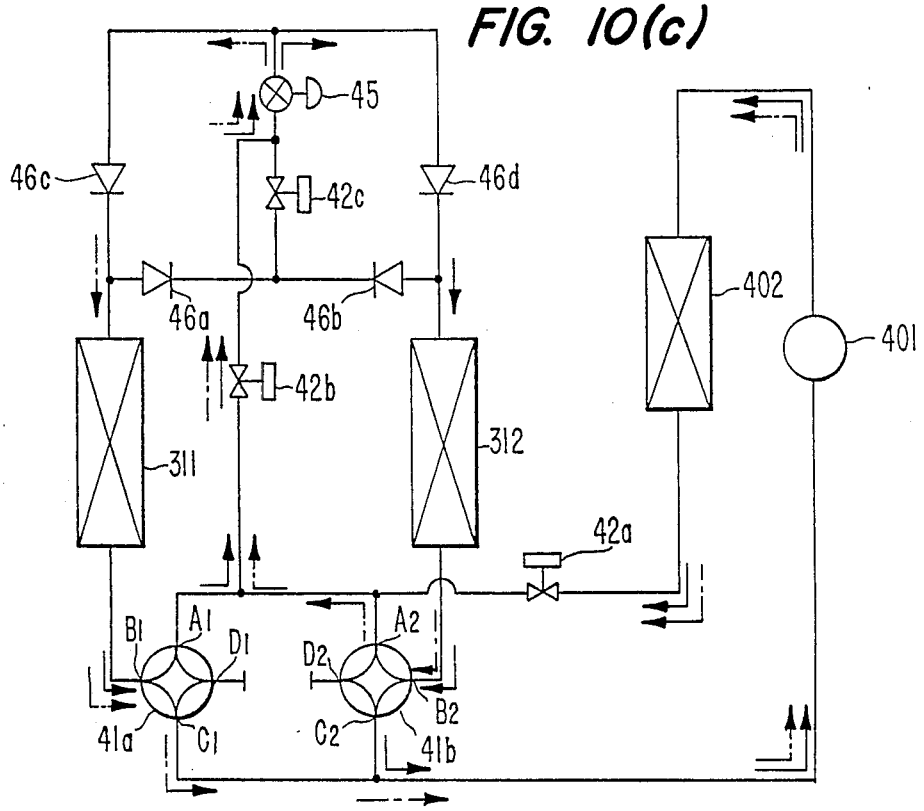

In this embodiment of refrigerating system 40, condensed refrigerant always passes through expansion valve 45 before flowing into evaporators 311, 312. The refrigerating mode is shown in FIG. 10(*a*), the defrosting mode is shown in FIG. 10(*b*) and the transmitting mode is shown in FIG. 10(*c*). These modes of operation proceed under similar conditions as described with reference to the embodiments of FIGS. 3 and 7.

In this embodiment, only one expansion valve is used in refrigerating system 40. Therefore, if the capacity of expansion is determined, the greatest load acting against the compressor may be reduced along with the cost of the refrigerating system.

Numerous characteristics and advantages of the invention have been described in detail in the foregoing description with reference to the accompanying drawings. However, the disclosure is illustrative only and the invention is not limited to the precise illustrated embodiments. Various changes and modifications may be affected therein by one skilled in the art without departing from the scope or spirit of the invention.

I claim:

1. In a refrigerated display cabinet comprising an external housing, an internal housing within the external housing for storing merchandise, a front opening for access to the interior of said internal housing, passage means formed between said external and internal housings including inner and outer conduits having respective inlets and outlets extending across opposite edges of said front opening, circulating means for driving air around said passage means and from said outlets to said inlets in the form of inner and outer air curtains, refrigerating means disposed in the inner conduit for refrigerating the inner air curtain, said refrigerating means comprising a compressor, a condenser, and two evaporators, the improvement comprising:

two four-way valves each connected to a bottom terminal port of a respective evaporator for selectively and alternately connecting said bottom terminal port of said evaporator to an outlet side of said condensor and a suction port of said compressor, a top terminal port of each said evaporator being connected to each other by first and second communicating lines connected in paralle, said communicating lines being connected to each other through a first control valve device, and at least one of said communicating lines being connected to a point between said two four-way valves through a second control valve device, at least one expansion valve located in one of said first and second communicating lines whereby said refrigerating means is capable of concurrently refrigerating the inner air curtain and defrosting one said evaporator.

2. The refrigerated display cabinet of claim 1 wherein said first and second control valve devices each comprise an electromagnetic valve.

3. The refrigerated display cabinet of claim 2 wherein said two communication lines comprise two check valves.

4. The refrigerated display cabinet of claim 3 wherein said first communicating line is connected to a point between said two four-way valves through said second control valve device.

5. The refrigerated display cabinet of claim 4 wherein said first communicating line is provided with two expansion valves and said second communicating line is provided with two check valves to restrict inflow of the refrigerant to each said evaporator.

6. The refrigerated display cabinet of claim 4 wherein said first communicating line is provided with two check valves to restrict outflow of refrigerant from each said evaporator, said second communicating line is provided with two check valves to restrict inflow of refrigerant to each said evaporator, and further comprising two expansion valves, one said expansion valve being disposed adjacent each said electromagnetic valve.

7. The refrigerated display cabinet of claim 3 wherein said first communicating line is provided with two check valves to restrict inflow of refrigerant to each said evaporator, said second communicating line is provided with two check valves to restrict outflow of refrigerant from each said evaporator, said expansion valve is disposed adjacent said first electromagnetic valve, and said second electromagnetic valve is connected to said at least one communicating line through said connection between said first and second communicating lines between said expansion valve and said first electromagnetic valve.

8. The refrigerated display cabinet of claim 3 wherein said evaporators are connected to said condensor through a third control valve device.

9. The refrigerated display cabinet of claim 3 wherein said electromagnetic valves are controlled by timer means for cycling operation of said evaporators between a refrigerating mode and a defrosting mode.

* * * * *